United States Patent [19]

Fosse

[11] 4,407,648

[45] Oct. 4, 1983

[54] COUNTER ROTATING PACKERHEAD ASSEMBLY

[75] Inventor: Navarro T. Fosse, Nashua, Iowa

[73] Assignee: Hydrotile Machinery Company, Nashua, Iowa

[21] Appl. No.: 366,870

[22] Filed: Apr. 9, 1982

Related U.S. Application Data

[60] Division of Ser. No. 188,301, Sep. 18, 1980, Pat. No. 4,340,553, which is a continuation-in-part of Ser. No. 974,303, Dec. 29, 1978.

[51] Int. Cl.[3] ..... B28B 21/26; B28B 1/28

[52] U.S. Cl. ..... 425/457; 425/262

[58] Field of Search ..... 425/262, 457

[56] References Cited

U.S. PATENT DOCUMENTS

| | | | |
|---|---|---|---|
| 402,029 | 4/1889 | McNeal et al. | 264/178 |
| 921,142 | 5/1909 | Myers et al. | 425/252 |
| 1,938,230 | 12/1933 | Ukropina | 35/30 |
| 2,751,657 | 6/1956 | Holston | 25/36 |
| 3,096,556 | 7/1963 | Woods | 25/36 |
| 3,262,175 | 7/1966 | Gourlie et al. | 25/36 |
| 3,276,091 | 10/1966 | Pausch | 25/36 |
| 3,733,163 | 5/1973 | Hermann | 425/262 |
| 3,746,494 | 7/1973 | Gauger | 425/262 |

*Primary Examiner*—Willard E. Hoag

*Attorney, Agent, or Firm*—Burd, Bartz & Gutenkauf

[57] ABSTRACT

A concrete product making machine having a counter rotating packerhead assembly and a concrete supply control operable to maintain a desired amount of concrete in the mold above the packerhead assembly. The counter rotating packerhead assembly has a first packerhead unit rotated in one direction by a motor and a second packerhead unit rotated in an opposite direction by hydraulic motors mounted on the cross head of the machine. The second packerhead unit located above the first packerhead unit has a plurality of rollers and an annular trowel. The trowel has radially adjustable shoes which meter the flow of concrete to the first packerhead unit. A control system responsive to hydraulic fluid pressure supplied to the hydraulic motors controls the operation of a concrete supply conveyor operable to deliver concrete to the chamber above the packerhead assembly. The control system includes a control valve assembly operable to regulate the supply of hydraulic fluid to a hydraulic motor operating the conveyor.

26 Claims, 13 Drawing Figures

COUNTER ROTATING PACKERHEAD ASSEMBLY

CROSS REFERENCE TO RELATED APPLICATION

This is a division of application Ser. No. 188,301 filed Sept. 18, 1980 and, now U.S. Pat. No. 4,340,553, which is a continuation-in-part of application Ser. No. 974,303, filed Dec. 29, 1978.

SUMMARY OF INVENTION

The invention is directed to a method and apparatus for making a concrete product, such as a concrete pipe. A packerhead concrete pipe making machine provided with feed control apparatus for controlling the amount of concrete above the packerhead during the formation of the pipe is disclosed by Fosse in U.S. Pat. No. 3,619,872. This apparatus has concrete level sensing devices, such as probes, located at or near the packerhead. Electrical circuits are used to control the hydraulic fluid to the conveyor motor.

One of the problems in the manufacture of concrete pipe by the packerhead method is that the reinforcing cage located in the concrete pipe will wind up under the torsional stresses of the rotating packerhead. When the concrete pipe is removed from the mold or jacket the cage will spring back causing torsional cracks in the barrel of the pipe. To alleviate this problem the packerheads were provided with counter rotating structures. An example of a counter rotating packerhead is shown by Woods in U.S. Pat. No. 3,096,556.

The concrete product making machine of the invention has a counter rotating packerhead assembly having first and second packerhead units. Each packerhead unit has roller means for working and packing concrete into engagement with a mold wall. The first packerhead unit has annular shoe or trowel means that are radially adjustable to control the metering of concrete to the roller means of the second packerhead unit. The second packerhead unit includes trowel means for working and finishing the inside surface of the concrete product. The first packerhead unit located above the second packerhead unit is driven by hydraulic drive means that rotates a sleeve or shaft housing surrounding the drive shaft for the first packerhead unit. The second packerhead unit is driven by a motor on the cross head in the conventional manner. The first and second packerhead units are simultaneously rotated in opposite directions and concurrently move upwardly within the mold to form a cylindrical concrete product. The upper or first packerhead unit rotates at a slower speed than the lower or second packerhead unit. A self-compensating control is used to regulate the speed of a conveyor motor that operates a conveyor that delivers concrete to the top of the packerhead assembly. The control includes a cylinder connected to the hydraulic fluid line that delivers fluid under pressure to the hydraulic drive means, as a hydraulic drive motor, that rotates the upper packerhead unit. The cylinder controls the operation of a control valve used to supply hydraulic fluid under pressure to the conveyor motor. When the pressure of the hydraulic fluid supplied to the hydraulic motor for driving the upper packerhead unit increases, the cylinder functions to restrict or close the valve thereby limiting the amount of hydraulic fluid supplied to the conveyor motor thereby reducing the speed of the conveyor. The load on the hydraulic motor is in direct relation to the pressure of the hydraulic fluid being supplied to the hydraulic motor. The amount of concrete above the packerhead determines the load on the hydraulic motor. When the amount of concrete above the packerhead assembly is reduced the pressure of the hydraulic fluid supplied to the hydraulic motor is reduced. This reduction in the hydraulic pressure allows the valve assembly of the control to permit an increase of flow of hydraulic fluid to the conveyor motor thereby increasing the conveyor speed and amount of concrete discharged by the conveyor. This conveyor speed control means automatically controls the supply of concrete to the packerhead. A biasing assembly including a spring acts on a control arm to provide for adjustment of the level or amount of concrete that is maintained on the packerhead during the forming of the concrete product.

The concrete product making machine equipped with counter rotating upper and lower packerhead units of the invention produces acceptable concrete product, as pipe, in less time and with less concrete than can be produced with a conventional packerhead concrete pipe making machine. The concrete product is produced in a single pass operation. The single pass operation results in less wear on the packerhead units, less concrete falls through product into the pit and the packerhead untis run cleaner, since the packerhead assembly is not forced through the pipe backwards. The counter rotating packerhead units have eliminated cage twist and resultant torsional cracking and shearing of the wall of the concrete product. The integrity of the final concrete product is uniform and sufficient to allow the product to be used as a fluid low pressure pipe. Progressive packing and troweling of the concrete in opposite directions by the packerhead assembly substantially reduces voids adjacent to the wires of the reinforcing cage embedded in the concrete. The overall advantage of the concrete product making machine of the invention is in the cost savings in producing quality concrete products. These and other advantages of the concrete product making machine and method are embodied in the machine and method set out in the following description thereof.

IN THE DRAWINGS

DESCRIPTION OF PREFERRED EMBODIMENT

Figure 1:
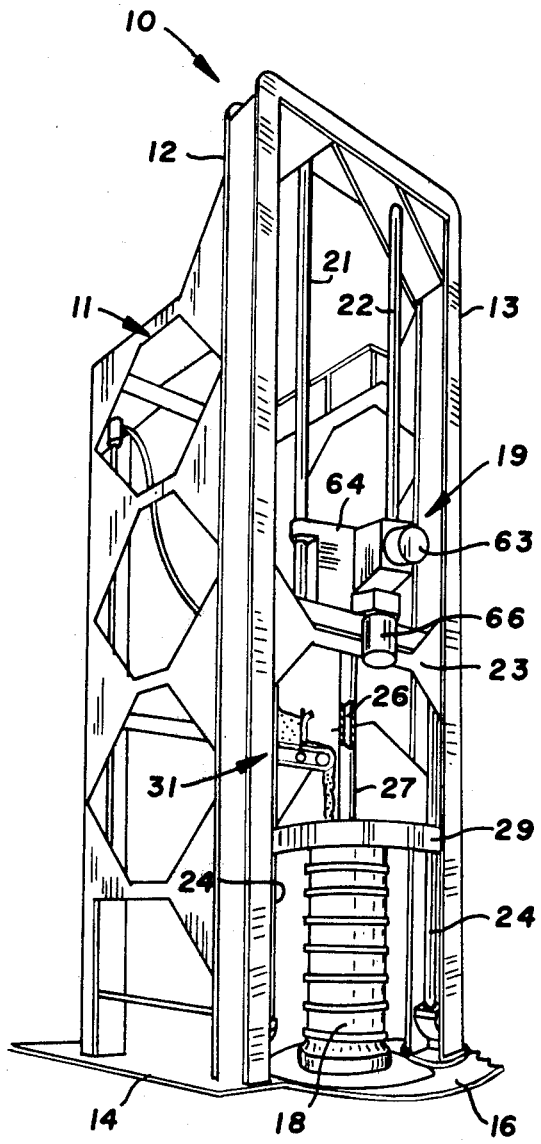
FIG. 1 is a perspective view of a packerhead concrete product making machine equipped with the counter rotating packerhead assembly and concrete feed control of the invention.

Referring to FIG. 1, there is shown a packerhead concrete pipe making machine indicated generally at 10. Machine 10 has an upright framework 11 comprising a number of upright beams and cross beams including main upright beams 12 and 13. The beams of the framework are welded together with suitable welds and gusset plates to provide a strong unitary framework 11. Framework 11 extends upwardly from support 14 carrying a movable turntable 16. Turntable 16 is adapted to support a pallet 17, shown in FIG. 5, and a cylindrical jacket or mold 18 used in the making of a concrete pipe.

A cross head indicated generally at 19 is located between beams 12 and 13. Upright cylindrical guides 21 and 22 movably support cross head 19 for vertical movement between a first or lower position, as shown in FIG. 1, to an upright or top position adjacent the top of framework 11. The lower ends of guides 21 and 22 are secured to a cross beam 23. Lift cylinders 24 secured to the lower ends of beams 12 and 13 are attached to opposite ends of cross head 19. Lift cylinders 24 are operable to move cross head 19 along the upright paths established by guides 21 and 22. Two lift cylinders 24 located adjacent the inside of beams 12 and 13 are connected to opposite ends of cross head 19. The machine can be provided with four lift cylinders. Two lift cylinders can be mounted on beam 12 and two lift cylinders can be mounted on beam 13.

Figure 2:
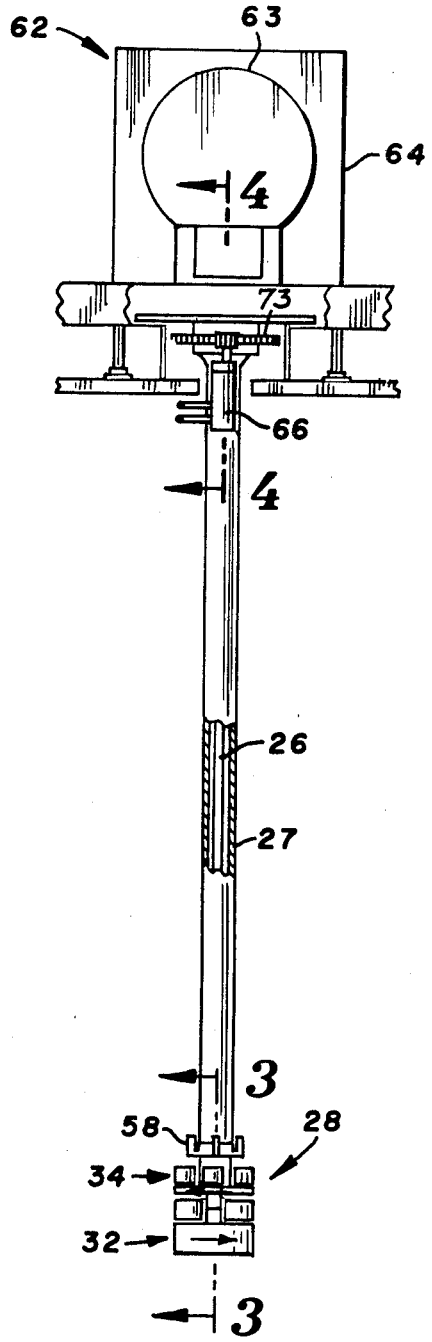
FIG. 2 is an enlarged partly sectioned front view of the counter rotating packerhead assembly and drive therefor.

Cross head 19 supports downwardly directed first drive shaft 26 surrounded by a downwardly directed tubular second drive shaft or sleeve 27. A counter rotating packerhead assembly indicated generally at 28, in FIG. 2, is connected to shaft 26 and sleeve 27. The details of packerhead assembly 28 are hereinafter described.

A top table 29 is located above the top end of jacket 18. Top table 29 receives concrete from a conveyor indicated generally at 31. Conveyor 31 directs concrete 95 into jacket 18 above packerhead 28.

Figure 3:
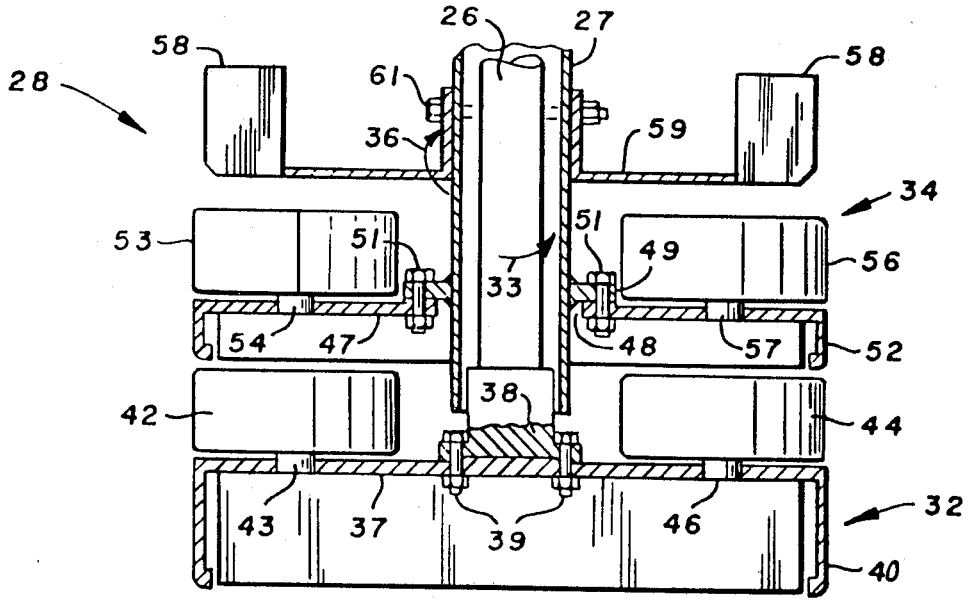
FIG. 3 is an enlarged sectional view taken along the line 3—3 of FIG. 2.

Referring to FIG. 3, packerhead assembly 28 has an upper or first packerhead unit indicated generally at 34 secured to sleeve 27 above packerhead unit 32 is driven in the direction of arrow 36 or in the direction opposite the direction of rotation of a lower packerhead unit 32. Lower or second packerhead unit indicated generally at 32 is driven by shaft 26 in the direction of arrow 33. Preferably, the upper packerhead unit 34 rotates slower than the lower packerhead unit 32.

Lower packerhead unit 32 has a cylindrical base plate or disc 37 attached to a head 38 secured to the lower end of shaft 26. A plurality of nut and bolt assemblies 39 attach head 38 to the center of disc 37. A downwardly directed cylindrical side wall or sleeve 40 is secured to the outer peripheral edge of disc 37. Side-by-side shoes or arcuate hard metal castings (not shown) can be attached to wall 40 with nut and bolt assemblies, as plow bolts. The nut and bolt assemblies allow the shoes to be removed from wall 40 for servicing, repair or replacement. The shoes have smooth outer cylindrical troweling surfaces that work the concrete in jacket 18 as packerhead unit 32 is rotated during the forming of the pipe and finish the inside surface of the concrete pipe. An example of removable troweling shoes on the lower packerhead unit is shown by shoes 231 in FIGS. 7 and 11. A plurality of cylindrical rollers 42 and 44 are rotatably mounted on the top of base or disc 37. An upright axle 43 rotatably mounts roller 42. In a similar manner, an upright axle 46 rotatably mounts roller 44. Preferably five rollers are rotatably mounted on disc 37. The outer peripheral edges of rollers 42 and 44 are located in general vertical alignment with the outer surfaces of shoes or troweling surface of sleeve 40. The troweling surface is preferably inwardly of the outermost edge of rollers 42 and 44.

Upper packerhead unit 34 has a base plate or annular plate 47 having a central opening 48 accommodating the lower end of sleeve 27. A ring 49 is secured by welds to sleeve 27. A plurality of nut and bolt assemblies 51 attach annular plate 47 to ring 49. A cylindrical downwardly directed side wall or annular flange 52 is secured to the outer peripheral edge of annular plate 47. Wall 52 has an outer cylindrical surface generally smaller in diameter than the outer surface of sleeve 40. A plurality of side-by-side shoes can be mounted on wall 52 to provide replaceable wearing members that meter the concrete to the lower packerhead. Wall 52 or shoes mounted thereon meter the flow of concrete to rollers 42 and 44 of lower packerhead unit 32. Wall 52 has a width or vertical height that is less than one-half of the height of sleeve 40. A plurality of rollers 53 and 56 are rotatably mounted on top of annular plate 47. An axle 54 rotatably mounts roller 53 on plate 47. An axle 57 rotatably mounts roller 46 on plate 47. In one preferred embodiment five rollers are rotatably mounted on annular plate 47. In another embodiment six rollers are mounted on annular plate 47. The six rollers have diameters smaller than the diameter of rollers 42 and 44. The outer edges of rollers 53 and 56 are spaced outwardly from the vertical extent of the outer cylindrical surface of wall 52.

A plurality of upright fins or arms 58 are secured to sleeve 27 above rollers 53 and 56. Arms 58 are attached to horizontal supports 59. A plurality of nut and bolt assemblies 61 clamp supports 59 to sleeve 27. Other types of attaching structures can be used to secure arms 58 to sleeve 27. Arms 58 are flat upright blades or plates that extend in a radial direction. Arms 58 rotate with sleeve 27 to move concrete in an outward direction toward the inside wall of jacket 18 and provide an annular supply of concrete for rollers 53 and 56. Rollers 53 and 56 rotate about their support pivots as they move with plate 47 in a circular path about the axis of tubular shaft or sleeve 27 to move concrete in engagement with the inside surface of mold 18 and work and pack the concrete into an annular shape.

Referring to FIGS. 1 and 2, drive means indicated generally at 62 is operable to rotate first and second packerhead units 32 and 34 in opposite rotational directions. Drive means 62 includes an electric motor 63 mounted on cross head 19. Motor 63 operates to transmit power to a gear box or transmission 64. Transmission 64 is connected with suitable gearing (not shown) to packerhead drive shaft 26. Sleeve 27 is rotated with a pair of hydraulic motors 66 and 67. One hydraulic motor, as motor 66, can be used to drive gear 73. Motors 66 and 67 drive sleeve 27 and packerhead unit 34 at a rate of speed that is slower than the speed of rotation of packerhead unit 32.

Figure 4:
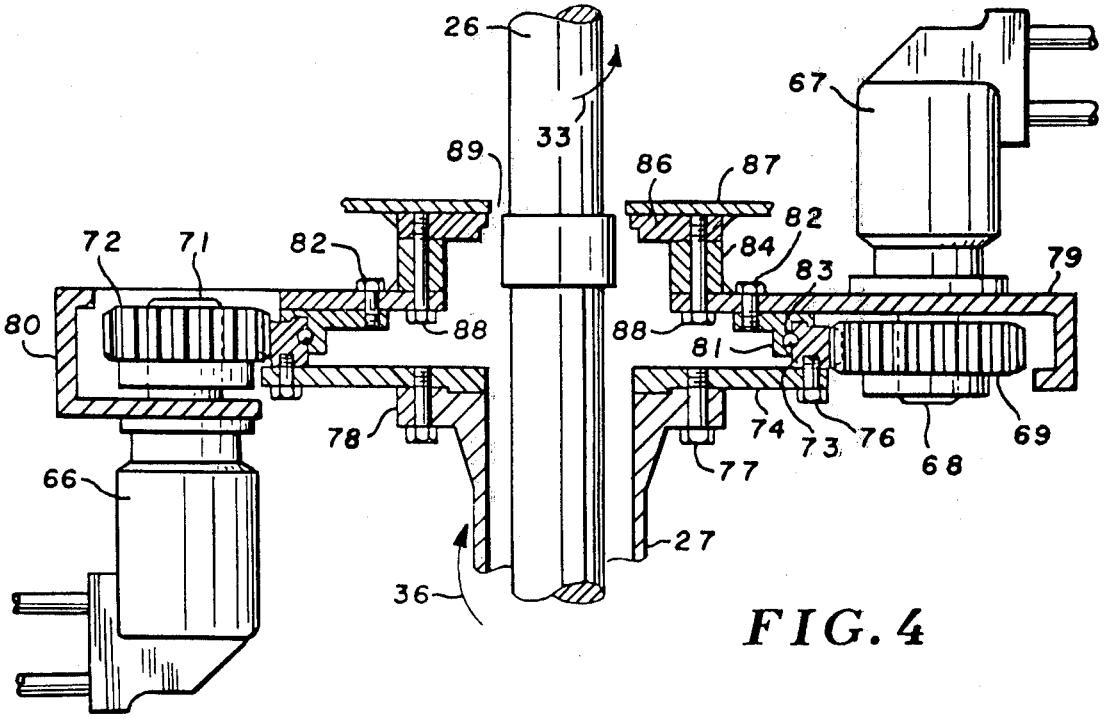
FIG. 4 is an enlarged sectional view taken along the line 4—4 of FIG. 2.

Referring to FIG. 4, drive motor 67 has a downwardly directed drive shaft 68 carrying a drive gear 69. Gear 69 is in driving engagement with a large ring gear 73. Motor 66 has an upwardly directed drive shaft 71 carrying a gear 72. Gear 72 is in driving engagement with ring gear 73. Gears 69 and 72 engage opposite diametric portions of ring gear 73 and are rotated in the same direction by their respective motors 66 and 67.

Ring gear 73 supports a horizontal annular plate 74. A plurality of bolts 77 secure ring gear 73 to plate 74. The inner annular portion of plate 74 has a central opening accommodating the shaft 26 and rests on an outwardly directed flange 78 joined to the top end of sleeve 27. A plurality fo bolts 77 secure flange 78 to plate 74 to support sleeve 27 in a concentric position about shaft 26.

Motors 66 and 67 are supported by a horizontal support plate 79. A downwardly directed bracket 80 secured to plate 79 supports motor 66. An annular member 81 attached to the lower side of plate 79 with bolts 82 supports an annular bearing 83. Bearing 83 rotatably mounts ring gear 73 on annular member 81.

A collar 84 is attached by suitable welds or the like to the center portion of support plate 79. Collar 84 bears against a support ring 86 secured by welds or the like to base 87 of the gear case housing of the cross head 19. A plurality of bolts 88 attach plate 79 and collar 84 to ring 86. Ring 86 and plate 79 have central openings 89 accommodating the shaft 26.

Figure 5:
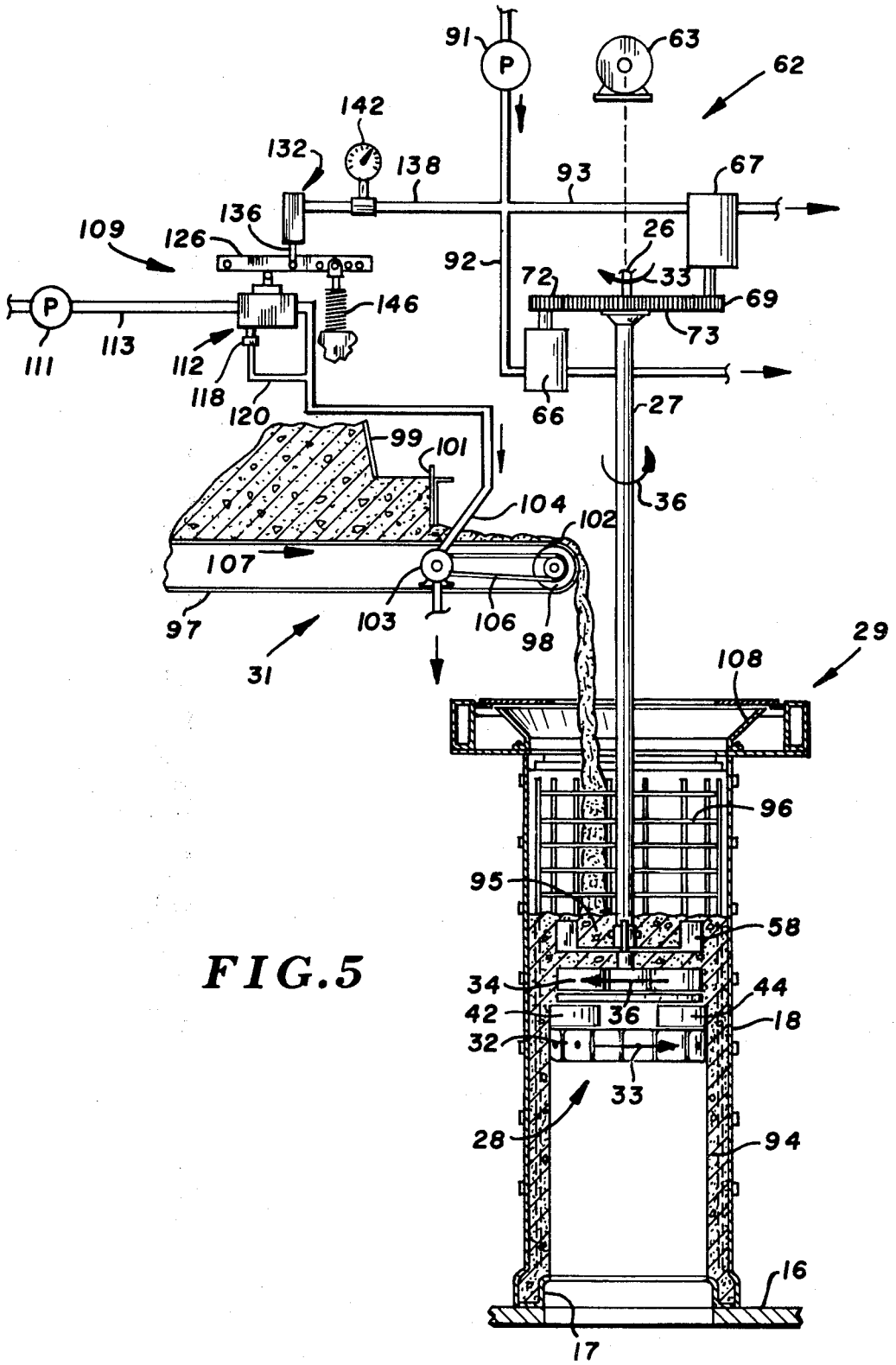
FIG. 5 is a diagrammatic view of the counter rotating packerhead assembly, conveyor drive system, and the concrete feed control of the machine of FIG. 1.

Referring to FIG. 5, pump 91 operates to supply motor 66 with hydraulic fluid under pressure via a hose 92. A second hose 93 carries the hydraulic fluid under pressure to motor 67.

Packerhead assembly 28 is located within jacket 18. In use, the packerhead assembly 28 is simultaneously rotated, as indicated by arrows 33 and 26, and moved in an upward direction to form concrete pipe 94. Conveyor 31 is operable to provide a continuous supply of concrete 95 above packerhead assembly 28. Packerhead assembly 28 operates as it rotates and moves upwardly and to pack concrete 95 in a cylindrical configuration in the space between the packerhead and jacket 18 about the upright reinforcing cage 96. The counter rotating packerhead units 32 and 34 provide even packing of concrete from the bottom to the top of the pipe and eliminate twisting of cage 96.

Conveyor 31 has an endless feed belt 97 trained about a drive roller 98 and an ideler roller (not shown). A hopper 99 storing a supply of concrete is located above belt 97. Front section of hopper 99 has a concrete flow regulator gate 101 used to adjust the amount of concrete 102 that is carried forward by belt 106 in the direction of the arrow 107 to feeding device 108 supported by top table 29. The feeding device can have a funnel shaped member and scraper blades, as disclosed in U.S. Pat. No. 3,551,968. Other types of feeding devices can be used in association with top table 29 to direct the concrete into the upper end of jacket 18 above packerhead 28. A hydraulic motor 103 is drivably connected to the belt drive roller 98 via an endless drive belt 106. A hose 104 carries hydraulic fluid under pressure to motor 103. The speed of motor 103 is regulated by the amount and pressure of hydraulic fluid delivered to motor 103 via line 104.

A control means indicated generally at 109 is operable to control the flow of hydraulic fluid under pressure to motor 103 in response to the amount of concrete 95 above packerhead assembly 28. The amount of concrete 95 above packerhead assembly 28 should be kept at a substantially uniform amount during the formation of the pipe to insure the integrity of pipe wall and allow maximum speed of operation of the machine.

Figure 6:
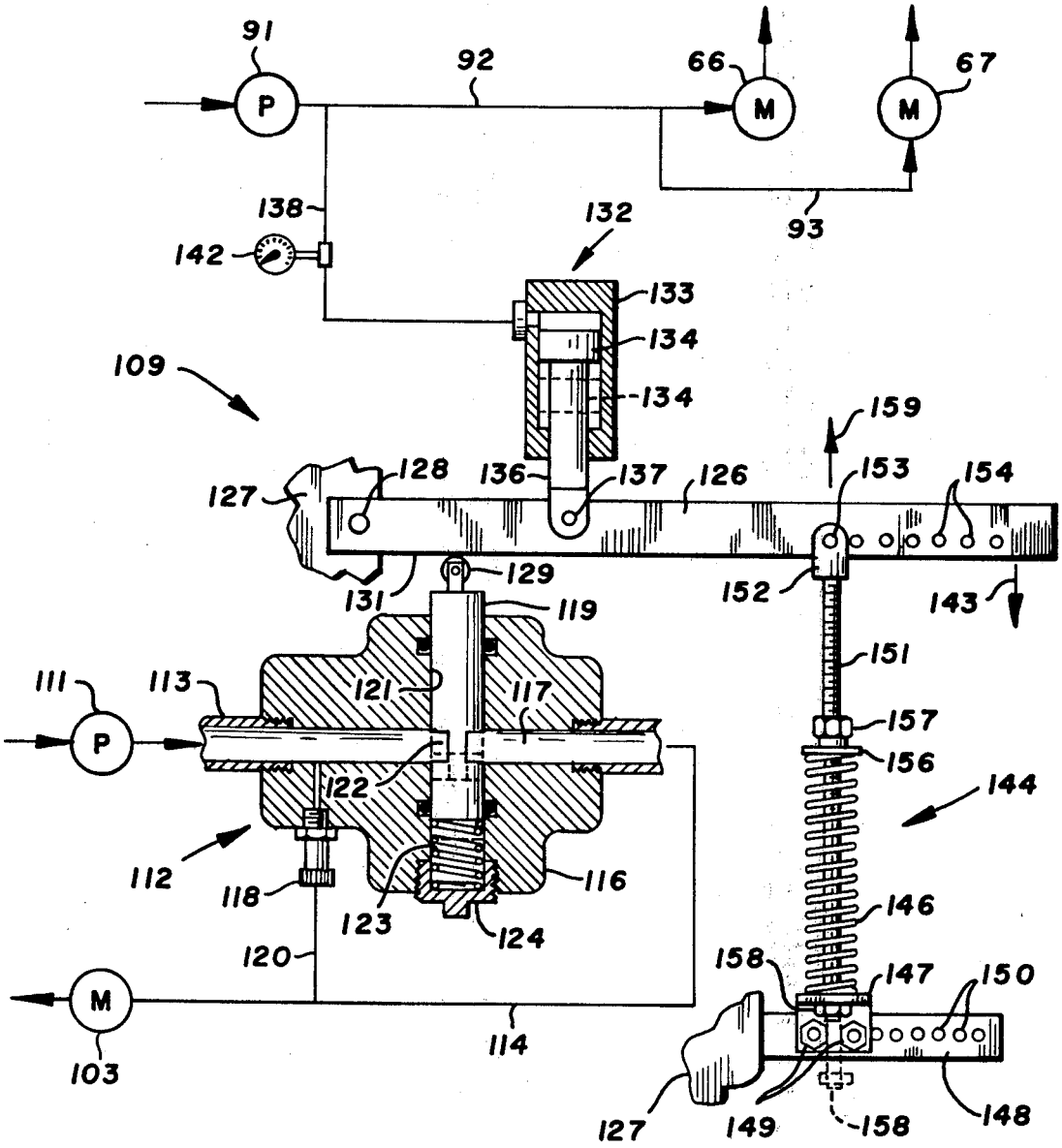
FIG. 6 is a diagrammatic view of the hydraulic fluid control structure for regulating the speed of the conveyor motor of the packerhead machine of FIG. 1.

Control means 109 operates to control the flow of hydraulic fluid from pump 111 to conveyor motor 103. Referring to FIG. 6, control means 109 has a valve assembly indicated generally at 112 connected with a line or hose 113 to pump 111. A line 114 connects valve assembly 112 to conveyor motor 103. Valve assembly 112 has a body or housing 116 having a passage 117 connecting lines 113 and 114. A by-pass valve 118 mounted on body 116 is in communication with passage 117. A line 120 connects valve 118 to conveyor motor line 104. Valve 118 is adjustable to regulate the flow of hydraulic fluid to conveyor motor 103. Valve 118 can be set so that a small amount of fluid will continuously flow to motor 103 so that conveyor 97 will not stop completely. This provides conveyor 31 with a speeding up or slowing down effect, rather than a start and stop operation.

The flow of hydraulic fluid through passage 117 is controlled with a movable spool or valving member 119. Spool 119 is located in a cylindrical bore 121 extended generally perpendicular to and intersecting passage 117. Spool 119 has an annular recess 122 allowing fluid to flow through passage 117 when recess 122 is aligned with the passage. Spool 119 is moved to a down or closed position, as shown in broken lines, against the biasing force of a spring 123 located in the bottom of bore 121. The bottom of bore 121 is closed with a plug 124 threaded into body 116. Conventional seals cooperate with spool 119 to prevent leakage of hydraulic fluid from valve assembly 112. Other types of valve assemblies can be used to control the flow of hydraulic fluid from pump 111 to conveyor motor 103.

The position of spool 119 in bore 121 is conrtrolled with an elongated control arm 126 located above valve assembly 112. One end of the control arm 126 is pivotally mounted on a fixed support 127 with a pivot pin 128. A roller or wheel 129 is rotatably mounted on the upper end of spool 119. Wheel 129 engages the lower linear edge 131 of arm 126. Arm 126 is pivoted or moved about pivot pin 128 with a first control comprising a hydraulic linear motor 132, shown as a piston and cylinder assembly. Motor 132 has a cylinder 133 accommodating a reciprocating piston 134. A piston rod 136 connected to piston 134 is joined to an intermediate portion of arm 126 with a pivot pin 137. Hydraulic fluid under pressure from line 92 is carried via a line or hose 138 to cylinder 133. Line 138 is connected to a gauge 142. Gauge 142 has a conventional visual pressure indicator dial. Gauge 142 is located in the operators position so that the hydraulic fluid pressure can be monitored during the concrete product making operation.

When hydraulic fluid under pressure is supplied to motor 132 piston 134 is moved in a downward direction thereby moving control arm 126 in the direction of arrow 143. Arm 126 moves down against a reaction biasing means indicated generally at 144. Biasing means 144 has a compression spring 146 resting on a bracket 147. Bracket 147 is secured to a base 148 fixed to support 127 with a plurality of bolt and nut assemblies 149. Base 148 has a plurality of laterally spaced holes 150 adapted to accommodate nut and bolt assemblies 149 so that the bracket 147 can be adjusted along the length of base 148. Spring 146 surrounds an upright rod 151. The upper end of rod 151 is attached to a U-shaped member or clevis 152. A pin 153 pivotally connects clevis 152 to the outer end portion of control arm 126. Control arm 126 has a plurality of laterally spaced holes 154 for accommodating pin 153. Biasing means 144 is adjustably positioned along the length of the control arm 126 by selecting the location of bracket 147 on support 148 and location of pin 153 in one of the holes 154. The upper end of spring 146 bears against a washer 156 engageable with a nut 157 threaded onto rod 151. The lower end of spring 146 rests on the top of bracket 147. Nut 157 is adjustable to change the compression of spring 146. A nut 158 threaded on the lower end of rod 51 functions as a stop to hold the rod 151 in operative relationship with bracket 147. Spring 146 biases control arm 126 in an upward direction, as indicated by arrow 159, against the pressure of the hydraulic fluid in cylinder 133.

In use, referring to FIG. 5, packerhead assembly 28 is first positioned in the bottom of jacket 18 adjacent pallet 17. Conveyor 31 is operated by supplying hydraulic fluid under pressure to hydraulic motor 103. Concrete 102 is moved by conveyor belt 31 into jacket 18 on top of packerhead assembly 28. Drive means 62 is operated to rotate first and second packerhead units 32 and 34 in opposite directions, as indicated by arrows 33 and 36. The counter rotating packerhead units 32 and 34 form the concrete pipe 94 adjacent the inside wall of jacket 18 as the packerhead assembly 28 moves up the mold chamber. Concrete 95 above packerhead assembly 28 is stirred and moved by fins 58 in an outward direction as fins 58 move with sleeve 27. Hydraulic motors 66 and 67 driving ring gear 73 rotate sleeve 27 thereby rotating fins 58 and second packerhead unit 34 in the direction of arrow 36. The supply of concrete 95 above packerhead assembly 28 is maintained relatively constant. As under supply of concrete above packerhead assembly 28 will slow the pipe making operation or produce defective pipes. An over supply of concrete 95 above packerhead assembly 28 will increase the load or power requirements of hydraulic motors 66 and 67 and result in an excess of concrete being moved onto top table 29. The upper packerhead unit works and moves the concrete into the annular space between rollers 53 and 56 and the inside of mold 18. Wall 52 meters concrete to rollers 42 and 44 of the second packerhead unit 32. Sleeve 40 trowels and finishes the inside wall of concrete pipe 94.

The hydraulic pressure required to operate fluid motors 66 and 67 is used to control the operation of the conveyor motor 103. When the pressure of the hydraulic fluid supplied to motors 66 and 67 is increased, control means 109 functions to limit the supply of hydraulic fluid to conveyor motor 103 thereby reducing the supply of concrete delivered to the top of packerhead assembly 28.

Referring to FIG. 6, cylinder 132 operates to move lever control arm 126 in a downward position. This moves spool 119 to a closed position, as indicated by broken lines. The flow of hydraulic fluid through passage 117 is restricted thereby reducing the operating speed of motor 103. Spring 146 is compressed. As soon as the pressure in cylinder 132 is reduced, spring 146 will move control arm 126 in an upward direction thereby allowing spool 119 under influence of spring 123 to move to the open positon. This restores the flow of hydraulic fluid to conveyor motor 103 and increases the speed thereof. The action of cylinder 132 is controlled by valve 139 and the position of biasing means 144 on base 148 and control arm 126. Locating biasing means 144 outwardly away from pivot 128 will increase the required fluid pressure on cylinder 132 to actuate the spool 119. In this manner, the amount or head of concrete 95 above packerhead assembly 28 can be selected.

Figure 7:
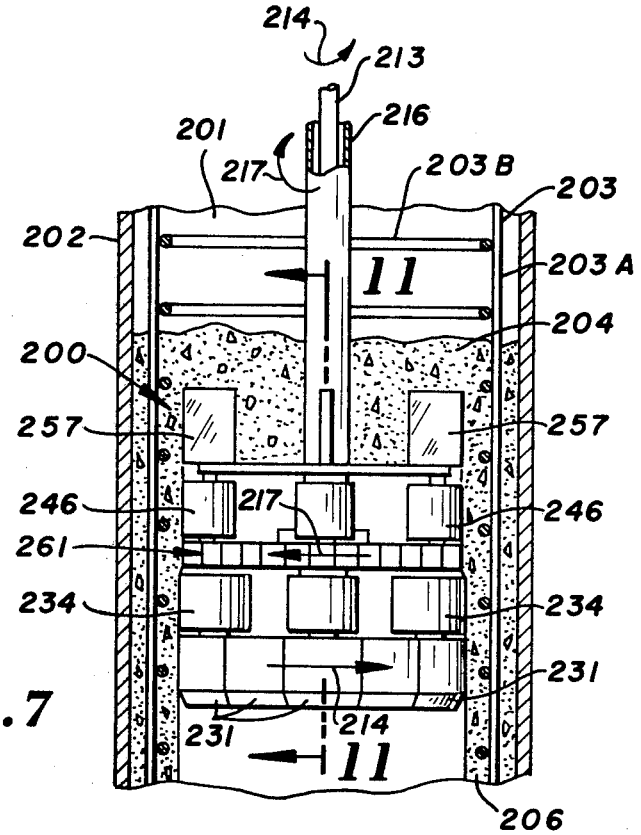
FIG. 7 is a side elevational view of a modified counter rotating packerhead assembly useable with the packerhead concrete product making machine shown in FIGS. 1-6.
Figure 9:
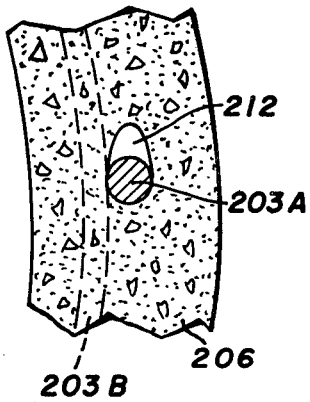
FIG. 9 is an enlarged sectional view taken along the line 9—9 of FIG. 8 showing a void due to twisted cage in a completed concrete pipe.

Referring to FIGS. 7 and 9, there is shown a modification of the counter rotating packerhead assembly indicated generally at 200 useable with the packerhead concrete product making machine shown in FIGS. 1-6. Packerhead assembly 200 is located in an upright cylindrical chamber 201 surrounded by an upright cylindrical jacket or mold 202. The lower end of mold 202 is supported on a turntable (not shown), such as turntable 16. A cylindrical wire reinforcing cage 203 is located in spaced relation inwardly from the inside wall of mold 202. Cage 203 has a plurality of circumferentially spaced longitudinal members 203A connected to vertically spaced circular members 203B forming an annular reinforcing means for the cylindrical concrete product, such as a concrete pipe. The conveyor 31, shown in FIG. 5, of the machine delivers concrete 204 to chamber 201 above packerhead assembly 200. The packerhead assembly 200 functions to concurrently rotate and move in an upward vertical direction to work and pack the concrete to form a cylindrical concrete product 206 without twisting cage 203.

Figure 8:
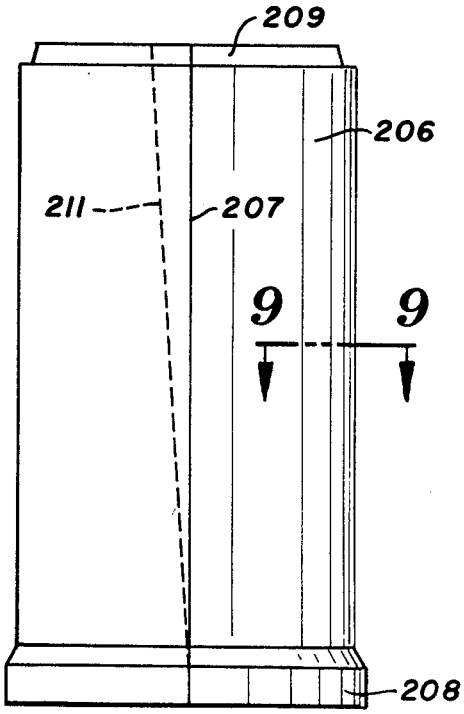
FIG. 8 is a side elevational view of a completed concrete pipe illustrating a twisted longitudinal seam due to cage twist.

Referring to FIG. 8, the completed cylindrical product 206 is an upright cylindrical concrete pipe having an outside cylindrical surface which includes a generally vertical seam 207. The seam 207 is a concrete mark formed by the vertical edges of the adjacent parts of the jacket 202 of a two-part jacket. The jacket 202 could be a three-part jacket which marks pipe 206 with three upright seams. Pipe 206 is shown as a sewer or water pipe having a bell or female end 208 and a spigot or male end 209. Spigot end 209 is adapted to fit into the bell of adjacent pipes to form a continuous line of pipes. Suitable seals (not shown) can be interposed between spigot end 209 and the bell end of an adjacent pipe.

In a conventional packerhead machine, the single packerhead has a plurality of rollers and a trowel assembly that rotates in one direction. The concrete being worked and packed against the inside wall of jacket 202 is subjected to circumferential force which angularly moves or twists cage 203. The twisted cage 203 functions as a torsion spring that is held under tension until jacket 203 is stripped from the concrete pipe. As soon as jacket 203 is stripped, the cage 203 will return back toward its neutral position, as cage 203 is not twisted beyond the elastic limit of the metal members 203A and 203B. As shown in FIG. 9, when cage 203 is released, the longitudinal member 203A will move in a circumferential direction. This causes a space or void 213 behind longitudinal members 203A. The voids or air pockets 212 weaken the walls of the pipe so that the pipe is unsuitable for use as a low pressure fluid pipe.

Returning to FIG. 8, the effects of the twisted cage are indicated on the outside of pipe 206 by an angular seam line 211. The counter rotating packerhead assembly 200 functions to work and pack the concrete during the forming of the pipe in opposite directions to minimize the angular movement or twisting of the cage 203.

Figure 10:
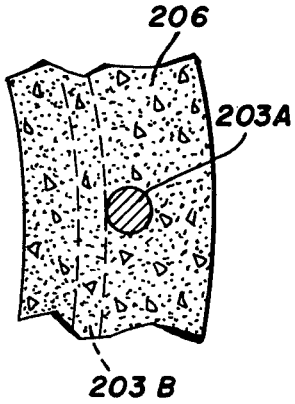
FIG. 10 is a sectional view similar to FIG. 9 showing non-twisted cage in a completed concrete pipe.

The result is that the longitudinal members 203A are not twisted. There is a minimum of circumferential movement of the longitudinal members so as to preclude the formation of spaces or voids adjacent the longitudinal members 203A, as shown in FIG. 10. This results in a concrete pipe having maximum wall integrity and strength which can be used as a low pressure fluid pipe. The fluid can be pressurized gas or liquid, including water.

Figure 11:
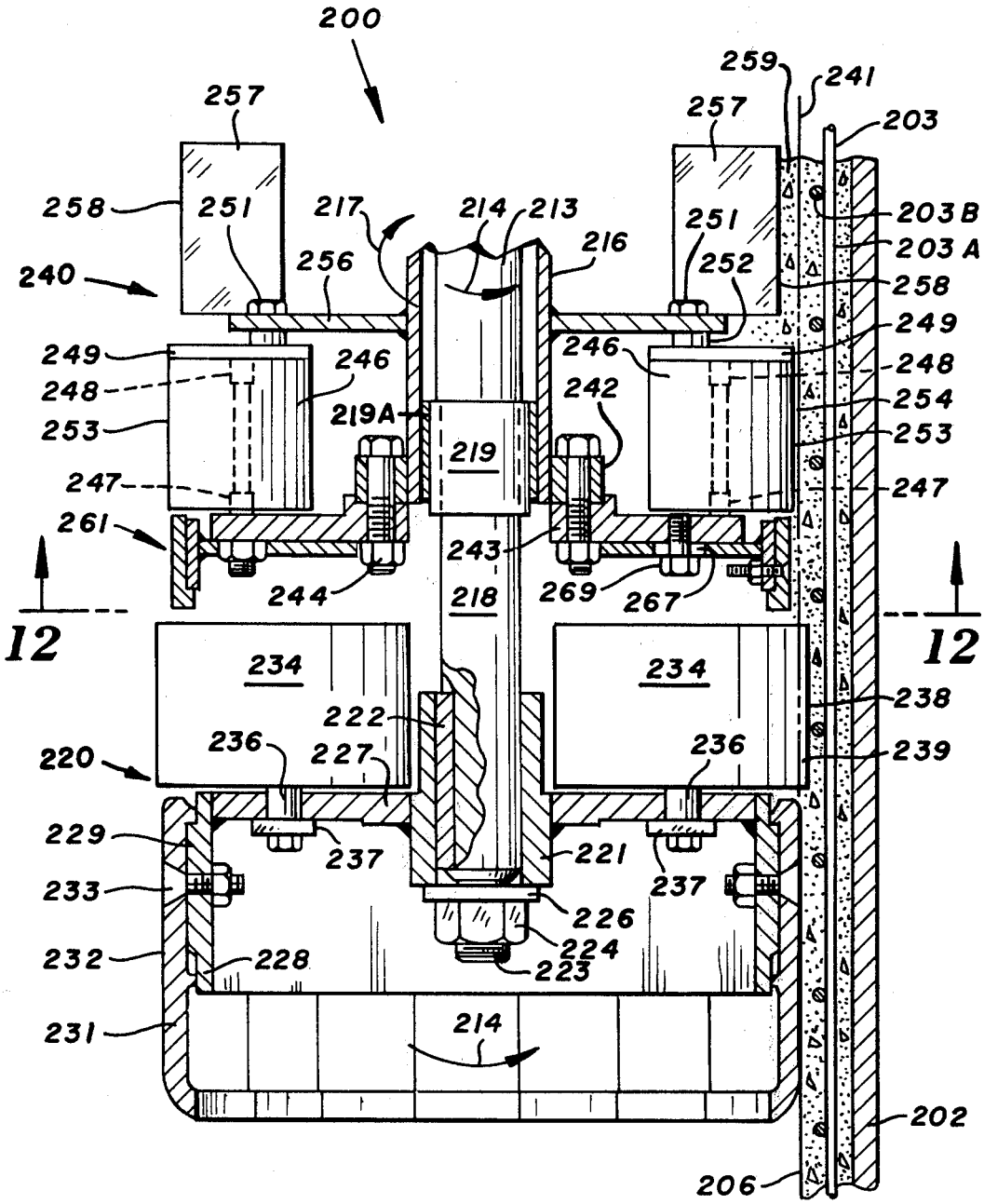
FIG. 11 is an enlarged sectional view taken along the line 11—11 of FIG. 7.

Referring to FIG. 11, packerhead assembly 200 is drivably coupled to a generally upright drive shaft 213 that is rotated in a counterclockwise direction indicated by arrow 214. A second tubular shaft or sleeve 216 surrounds shaft 213 and is driven in a clockwise direction, as indicated by arrow 217. Shafts 213 and 216 are driven by separate drive means, such as drive means 63 and drive means 66 and 67, as shown in FIG. 5. A downwardly directed shaft extension 218 is at the lower end of shaft 213. A sleeve 219 supports an annular bearing 219A. A second packerhead unit 220 is drivably connected to shaft extension 218. Unit 220 has a hub 221 drivably connected to shaft extension 218 with a key 222. Other means, such as splines, can be used to drivably connect hub 221 to shaft extension 218. Shaft extension 218 has a threaded end 223 for accommodating a nut 224 and washer 226. Nut 224 holds hub 221 in driving assembled relation with shaft extension 218.

A circular plate or disc 227 is secured by welds or the like to a mid-portion of hub 221. An annular sleeve or wall 228 is secured to the outer circular portion of disc 227. Sleeve 228 has outwardly directed ribs 229 accommodating a plurality of arcuate shoes 231 which serve as troweling means. Shoes 231 provide a generally cylindrical surface 232 which functions as a troweling or concrete working surface. A plurality of nut and bolt assemblies 233, such as plow bolts, secure shoes 231 to sleeve 228.

A plurality of cylindrical rollers 234 are located above and rotatably mounted on disc 227 about separate upright axes. Each roller has a downwardly directed shaft 236 that is rotatably supported in a bearing 237 mounted on the bottom side of disc 227. Each roller 234 has an outer smooth cylindrical surface 238 that has an outer segment extended outward a radial distance 239 from a reference line 241 coinciding with cylindrical surface 232 of shoes 231 of the troweling means. Reference line 241 is an extension of the cylindrical surface 232 of trowel segments 231 and the inside wall of finished pipe 206.

A second packerhead unit 240 is drivably connected to the lower end of second tubular shaft 216. A circular member or ring 242 is secured to the lower end of shaft 216 and is attached to a circular generally horizontal plate 243 with a plurality of nut and bolt assemblies 244. Plate 243 rotatably supports a plurality of rollers 246. Preferably, five rollers are rotatably mounted for rotation about separate upright axes generally parallel to the axis of rotation of second shaft 216. The rollers 246 are rotatably mounted on lower axles 247 secured to plate 243 and an upper axle 248 attached to a disc or plate 249 located above the rollers 246. Bolts 251 secure plate 249 to a second disc 256. Disc 256 is a circular plate or hood that surrounds and is secured by welds to the second tubular shaft 216. Disc 256 prevents concrete from bailing inside of rollers 246. A spacer 252 is interposed between disc 256 and plate 249.

A plurality of upwardly directed generally flat fins or paddles 257 are secured to plate 256. Fins 257 have inner edges spaced outwardly from shaft 216 and generally upright outer edges 258 spaced inwardly by a radial distance 259 from reference line 241. For example, each edge 258 of fins 257 is spaced about $\frac{1}{2}$ inch, 1.27 cm, inwardly from reference line 241. Each fin 257 has a height of about 8 or more inches (20 cm). The outer edges 258 are generally parallel to the inside wall of mold 202.

Figure 12:
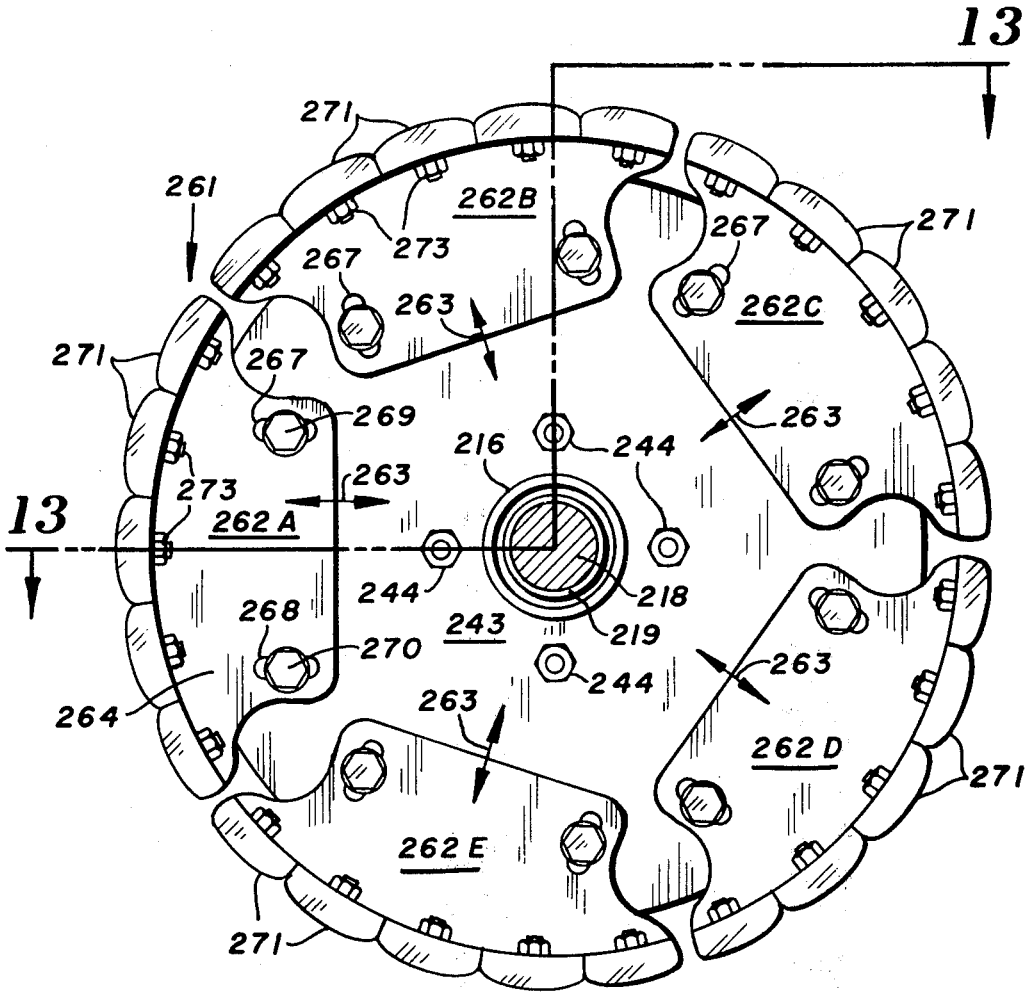
FIG. 12 is an enlarged sectional view taken along the line 12—12 of FIG. 11.
Figure 13:
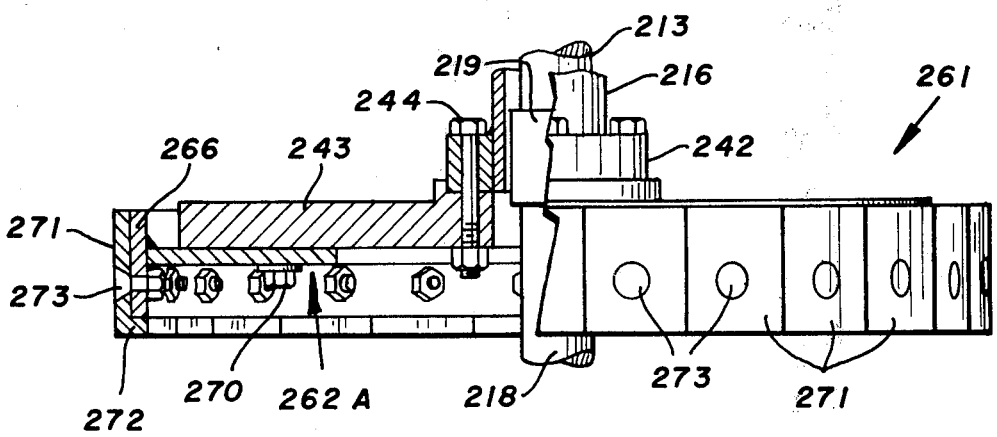
FIG. 13 is a side elevational view partly sectioned taken along the line 13—13 of FIG. 12.

As shown in FIGS. 12 and 13, an adjustable troweling means or shoe assembly indicated generally at 261 is mounted on plate 243. Shoe assembly 261 comprises a plurality of independent shoe supports 262A, 262B, 262C, 262D, and 262E circumferentially spaced around plate 243. Each shoe support 262A–E is radially adjustable, as indicated by the arrows 263, to change the size of the outer perimeter or overall working circumference of a plurality of shoes 271. Each shoe support 262A–E can be adjusted relative to the center of troweling means 261 to change the diameter of the outer working surfaces of the troweling means. Shoe supports 262A–E are identical in structure, The following description is limited to shoe support 262A. Shoe support 262A has a base or segment plate 262 that engages a portion of the bottom surface of plate 243. An arcuate band or strap 266 is secured to an outer curved edge of base 264. Base 264 has a pair of slots 267 and 268 that extend parallel to a diameter line bisecting the base 264. A pair of bolts 269 and 270 extended through slots 267 and 268 secure base 264 to plate 243. Bolts 269 and 270 can be released allowing shoe support 262A to be adjusted inwardly or outwardly to the extent permitted by the length of slots 267 and 268. Band 266 has an arcuate length such that it has opposite ends that contact adjacent bands of adjacent shoe supports, such as the bands on shoe supports 262B and 262C, when shoe supports 262A, 262B, and 262E are in their full in positions. When the shoe supports 262A–E are in their full out positions, the adjacent ends of the shoe supports are spaced circumferentially from each other. The outer peripheral surfaces of shoes 271 are spaced inwardly about $\frac{1}{4}$ inch or 0.62 cm from reference line 241. This space can be increased or decreased by moving shoe supports 262A–E inwardly or outwardly, as indicated by arrows 263 in FIG. 12.

A plurality of shoe liners 271 are attached to band 266. Each shoe liner 271 has an outwardly convex surface and an inwardly directed lip 272. The lip 272, as shown in FIG. 13, extends under band 266. Nut and bolt assemblies 273, as plow bolts, attach each shoe liner to band 266. Shoe liners 271 are made of hard wear-resistant material. They can be replaced by removing the nut and bolt assemblies 273 and mounting new shoe liners on band 266. Nut and bolt assemblies 273 are then refastened to hold new shoe liners in assembled relation with band 266.

Referring to FIG. 11, the outer peripheral surfaces of shoes 271 are spaced inwardly from reference line 241 and inwardly of a line coextensive with the outermost portion of the outer surface of rollers 246. In other words, the rollers 246 have outer surfaces that extend radially outwardly from the outer surfaces of shoes 271. When packerhead unit 240 is rotated, rollers 246 pack or compress concrete in the annular space between packerhead unit 240 and inside wall of mold 202. After the concrete leaves the rollers 246, it expands inwardly engaging troweling means 261. The rotating troweling means 261 works the concrete and meters concrete to rollers 234 of packerhead unit 220.

Packerhead unit 240 is set up with the fins 257 located radially inward of reference line 241 a distance shown as space 259. Preferably, the outer edges 258 of the fins 257 are spaced radially inward about ½ inch or 1.27 cm from reference line 241. Fins 257 stir and feed concrete to the annular space surrounding the packerhead unit 240 and form an initial annular concrete wall. The outer edges 258 of fins 257 can be trimmed back to increase the width of space 259 so that more concrete is fed to rollers 246.

The outer edge 253 of the outer surface of rollers 246 is located close to reference line 241. Edge 253 is spaced a short distance 254 radially inward of line 241. Distance 254 may be one eighth inch or less (0.3 cm). With reference to shoes 271 of the troweling means, roller edges 253 are located slightly outward from the outer surfaces of shoes 271.

Packerhead unit 220 has rollers 243 located in positions whereby the outer extent of the surfaces of the rollers 243, shown as edge 238, extend outwardly of reference line 241. This provides for increased packing and compaction of the concrete against the mold 202. Rollers 234 move in a circular path that is in a direction opposite to the direction of rotation of the rollers 246 and troweling means 261. This works the annular concrete wall in opposite circumferential directions during the forming of the concrete product and minimizes twisting of cage 203. Trowel 231 finishes the inside surface of the concrete product 206 and establishes the cylindrical reference line 241.

The operational method of making a concrete product with machine 10 having packerhead assembly 200 is as follows. Conveyor 31 operates to discharge concrete into chamber 201 above the counter rotating packerhead assembly 200. motor 63 on the cross head operates to rotate shaft 213 thereby rotating the lower packerhead unit 220 in the circumferential direction, as indicated by arrow 214. Hydraulic motors 266 and 267 operate to rotate the tubular shaft 216 in the circumferential direction of arrow 217 thereby rotating packerhead unit 240 in the direction opposite the direction of rotation of packerhead unit 220. Packerhead unit 240 is preferably rotated at a speed that is slower than the speed of rotation of packerhead unit 220. Fins 257 stir and move concrete above packerhead unit 240 adjacent the inside wall of mold 202. Fins initially form the cylindrical wall of the concrete product. This concrete wall is pressed and worked by rollers 246 as they rotate and circumferentially move with the drive shaft 216. Troweling means 261 works the inside surface of the concrete wall and meters concrete to rollers 234 of the packerhead unit 220. Since shoes 271 are located radially inward of roller outer edges 238, rollers 234 are provided with a continuous annular concrete wall. This annular concrete wall is packed around cage 203 and against mold 202.

The upper packerhead unit 240 provides a circumferential working force on the concrete that is opposed to the circumferential working force placed on the concrete by the lower packerhead unit 220. These forces are in opposite circumferential directions and generally cancel or nullify each other, thereby placing a minimum of torsional or twisting force on cage 203. Rollers 234 work the concrete in engagement with cage 203 and mold 202. Trowel 232 finishes the inside surface of the concrete product 206. The entire counter rotating packerhead assembly 200 is moved upwardly relative to mold chamber 201 from the bottom to the top of the chamber 201 to continuously build a uniform cylindrical concrete wall of product 206.

The speed of the conveyor 31 is regulated with fluid control system 102, as shown in FIGS. 5 and 6, whereby the amount of the concrete above the packerhead assembly 200 is maintained substantially constant. When the amount of concrete above the packerhead assembly 200 increases, the amount of torque required to rotate the upper packerhead unit 240 increases. The increased torque is proportional to the hydraulic pressure supplied to motors 66 and 67 for driving packerhead unit 240. This increase in the fluid pressure results in actuation of valve 112 in a manner to slow the speed of operation of conveyor motor 103 thereby reducing the amount of concrete discharged by conveyor 31 into mold chamber 201. When the amount of concrete above the packerhead unit 240 decreases, the speed of the conveyor increases as the amount of torque required to rotate the upper packerhead unit 240 decreases. The decrease in the torque of the motors 66 and 67 reduces the fluid pressure to operate these motors. This reduction in fluid pressure causes valve 112 to operate in a manner to increase the flow of fluid to the motor 103, which operates the conveyor 31. This increases the speed of conveyor 31 thereby discharging increased amounts of concrete into the mold chamber 201. In this manner, the level of the concrete above the packerhead assembly 200 is maintained substantially constant during the making of concrete product 206.

After the concrete product 206 is made, top table 29 is raised and turntable 16 rotated to move mold 16 and product 206 therein to a remote location. The mold is removed from the turntable 16 and stripped from the product 206. A subsequent product may be made in another mold located on turntable 16 below packerhead assembly 200.

While there is shown several embodiments of the counter rotating packerhead assembly of the invention, it is understood that modifications and changes in size, structure, and the machine used with the counter rotating packerhead assembly may be made by those skilled in the art without departing from the invention. The invention is defined in the following Claims.

The embodiments of the invention in which an exclusive property or privilege is claimed are defined as follows:

1. A counter rotating packerhead assembly for use with a machine to make a concrete product comprising: a rotatable lower packerhead unit having a plurality of first rollers with outer portions thereof operable to pack concrete into the annular space between the lower packerhead unit and the mold, means rotatably supporting the first rollers for rotation about separate axes extended generally parallel parallel to the axis of rotation of the lower packerhead unit, said means including plate means and means rotatably mounting the first rollers on the plate means and locating the first rollers above the plate means, a rotatable upper packerhead unit located above said lower packerhead unit, said first rollers being disposed immediately below said upper packerhead unit with no intermediate structure therebetween, said upper packerhead unit having a plurality of second rollers, each of said second rollers having outer portions operable to pack concrete in an annular space surrounding the upper packerhead unit, said outer portions of the second rollers being located radially inwardly of the outer portions of the first rollers, means rotatably supporting the second rollers for rotation about separate generally upright axes extended parallel to the axis of rotation of the upper packerhead unit, means fixedly mounting a finned impeller to said upper packerhead unit for rotation therewith, said upper packerhead unit having annular trowel means located between said first and second rollers, said trowel means having outer means located radially inward of said outer portions of the first and second rollers for troweling the concrete between the first and second rollers and metering concrete directly to the first rollers of the lower packerhead unit.

2. The packerhead assembly of claim 1 wherein: said trowel means has a plurality of shoe means, and means for adjusting the radial locations of each shoe means thereby changing the working diameter of the outer means of the trowel means.

3. The packerhead assembly of claim 1 wherein: said trowel means has a plurality of shoe means, and means mounting said shoe means in a manner allowing the position of each shoe means to be adjusted to change the working diameter of the outer means of the trowel means.

4. The packerhead assembly of claim 1 wherein: the lower packerhead unit has cylindrical trowel means located below said first rollers.

5. The packerhead assembly of claim 4 wherein: said cylindrical trowel means of the lower packerhead unit has cylindrically arranged trowel shoe means having outer faces located radially inward of said outer portions of the first rollers of the lower packerhead unit.

6. The packerhead assembly of claim 1 wherein: said upper packerhead unit includes a generally upright drive shaft, a generally horizontal support surrounding and secured to said drive shaft, said support being located above said second rollers, a plurality of upright fin means secured to and projected upwardly from the support operative on rotation of said upper packerhead unit to move concrete into an annular space above said second rollers.

7. The packerhead assembly of claim 6 wherein: said support is a disc having an annular outer edge located radially inward from the outer portions of said second rollers, each of said fin means having portions extended in a generally radial direction outwardly of said outer edge of the disc.

8. The packerhead assembly of claim 6 wherein: each of said fin means has an outer edge extended in a generally upward direction, said outer edge of the fin means being located radially inward from the outer portions of said second rollers.

9. The packerhead assembly of claim 6 wherein: each of said fin means has an inner edge spaced from said drive shaft.

10. The packerhead assembly of claim 1 wherein: the second packerhead unit has a drive shaft, said trowel means having a member secured to the drive shaft, a plurality of shoe means having said outer means, and means mounting the shoe means on the member in a manner allowing the position of each shoe means to be adjusted to change the working diameter of the outer means of the trowel means.

11. The packerhead assembly of claim 10 including: means on the member and shoe means allowing radial adjustment of the shoe means relative to the member to change the working diameter of said outer means, and releasable means mounting the support on the member.

12. The packerhead assembly of claim 10 wherein: each shoe means has a support mounted on the member, and shoes mounted on the support, each of said shoes having an outer face for troweling concrete.

13. The packerhead assembly of claim 12 including: means on the support and the member allowing radial adjustment of the support relative to the member, and releasable means mounting the support on the member in a selected position.

14. A counter rotating packerhead assembly for use with a machine to make a concrete product comprising: a rotatable lower packerhead unit having a plurality of first rollers with outer portions thereof operable to pack concrete into the annular space between the lower packerhead unit and the mold, means rotatably supporting the first rollers for rotation about separate axes extended generally parallel to the axis of rotation of the lower packerhead unit, said means including plate means and means rotatably mounting the first rollers on the plate means and locating the first rollers above the plate means, a rotatable upper packerhead unit located above said lower packerhead unit, said first rollers being disposed immediately below said upper packerhead unit with no intermediate structure therebetween, said upper packerhead unit having a plurality of second rollers, each of said second rollers having outer portions operable to pack concrete in an annular space surrounding the upper packerhead unit, means rotatably supporting the second rollers for rotation about separate generally upright axes extended parallel to the axis of rotation of the upper packerhead unit, said outer portions of the second rollers being located radially inwardly of said outer portions of the first rollers whereby concrete is metered by the upper packerhead unit directly to the first rollers of the lower packerhead unit, said upper and lower packerhead units being adapted to rotate in opposite directions.

15. The assembly of claim 14 wherein: said upper packerhead unit includes a drive shaft and a generally horizontal support surrounding and secured to said drive shaft, said means rotatably supporting the second rollers being secured to said support.

16. The assembly of claim 14 wherein: the lower packerhead unit has cylindrical trowel means for forming concrete into a concrete product in a mold.

17. The assembly of claim 16 wherein: said cylindrical trowel means has shoe means with outer surfaces located radially inwardly from the outer portions of the first rollers of the lower packerhead unit.

18. The assembly of claim 14 wherein: said upper packerhead unit includes a plurality of upright fin means located above said second rollers operable on rotation of the upper packerhead unit to move concrete outwardly and toward the second rollers.

19. The assembly of claim 18 wherein: said upper packerhead unit includes a generally upright drive shaft, a generally horizontal support surrounding and secured to said drive shaft, said fin means being fixed to said support.

20. The assembly of claim 19 wherein: said support is a disc having an annular outer edge located radially inwardly from the outer portions of said second rollers, each of said fin means having portions extended in generally radial directions outwardly from the outer edge of the disc.

21. The assembly of claim 18 wherein: each of said fin means has an outer edge extended in the generally upward direction, said outer edge of the fin means being located inwardly from the outer portions of said second rollers.

22. The assembly of claim 21 wherein: each of said fin means has an inner edge spaced from said drive shaft.

23. The assembly of claim 14 wherein: the upper packerhead unit has a drive shaft, trowel means having a member secured to the drive shaft, support means located adjacent the member, a plurality of shoe means having outer means for troweling concrete mounted on the support means, and means mounting the support means on the member in a manner allowing the position of each shoe means to be adjusted to change the working diameter of the outer means of the trowel means.

24. The assembly of claim 23 including: means on the member and shoe means allowing radial adjustment of the shoe means relative to the member to change the working diameter of said outer means, and releasable means mounting the support means on the member.

25. The assembly of claim 23 wherein: each shoe means has a support mounted on the member, shoes mounted on the support, each of said shoes having an outer face for troweling concrete.

26. The assembly of claim 25 including: means on the support and the member allowing radial adjustment of the support relative to the member, and releasable means mounting the support on the member in a selected position.

* * * * *

UNITED STATES PATENT AND TRADEMARK OFFICE

CERTIFICATE OF CORRECTION

PATENT NO. : 4,407,648

DATED : October 4, 1983

INVENTOR(S) : Navarro T. Fosse

It is certified that error appears in the above-identified patent and that said Letters Patent is hereby corrected as shown below:

Column 2, line 27, "untis" should be --units--.

Column 9, line 64, "bailing" should be --balling--.

Column 12, line 54, "parallel" (second occurrence) should be omitted.

Signed and Sealed this

*Twenty-second* Day of *May 1984*

[SEAL]

*Attest:*

GERALD J. MOSSINGHOFF

*Attesting Officer*

*Commissioner of Patents and Trademarks*